US005924458A

United States Patent [19]

Kaines

[11] Patent Number: 5,924,458

[45] Date of Patent: Jul. 20, 1999

[54] SELF-LOCKING STIRRUP MAT

[76] Inventor: John L. Kaines, 303 N. Gaylord Ave., Ludington, Mich. 49431

[21] Appl. No.: 08/747,205

[22] Filed: Nov. 12, 1996

[51] Int. Cl.[6] ..... F16L 55/00

[52] U.S. Cl. ..... 138/175; 138/172; 245/2; 245/3; 140/107

[58] Field of Search ..... 138/175, 176, 138/172, 174; 52/661, 662, 664, 676, 665; 245/2, 3, 11; 140/92.1, 107; 264/228

[56] References Cited

U.S. PATENT DOCUMENTS

| | | | |
|---|---|---|---|
| 3,411,545 | 11/1968 | Keyser | 138/175 |
| 3,419,047 | 12/1968 | Osweiler | 138/175 |
| 3,440,792 | 4/1969 | Schmidgall | 52/687 |
| 3,826,287 | 7/1974 | Tolliver | 138/175 |
| 3,840,054 | 10/1974 | Tolliver | 138/175 |
| 3,857,416 | 12/1974 | Borodin et al. | 138/175 |
| 4,067,521 | 1/1978 | Byard | 245/3 X |
| 4,184,520 | 1/1980 | Tolliver | 140/107 |
| 4,295,497 | 10/1981 | Tolliver | 138/175 |
| 4,295,501 | 10/1981 | Tolliver | 138/175 X |
| 4,345,626 | 8/1982 | Tolliver | 138/175 X |
| 4,439,972 | 4/1984 | Tolliver | 138/175 X |
| 4,441,527 | 4/1984 | Tolliver | 138/175 |
| 4,466,467 | 8/1984 | Tolliver | 138/175 |
| 4,467,995 | 8/1984 | Tolliver | 138/175 X |
| 4,494,576 | 1/1985 | Buttner | 138/175 |
| 4,999,965 | 3/1991 | Schmidgall et al. | 52/684 |
| 5,410,850 | 5/1995 | Dreizler | 52/309.17 |

*Primary Examiner*—Patrick F. Brinson
*Attorney, Agent, or Firm*—Waters & Morse, PC

[57] ABSTRACT

A self locking stirrup mat for providing supplemental support for wire cage concrete reinforcement comprises a stirrup mat formed of a grid of interconnected wires preferably with manually formable tie wires, stirrup elements projecting from the grid, and a self-locking attachment mechanism for attaching the stirrup mat to a wire cage. The self-locking attachment mechanism comprises a plurality of clips fixed at spaced locations on the grid. The clips are shaped and positioned to receive cage wires therein through inlets that are engaged by moving the stirrup mat on the surface of the cage. The clips have one-way inlets that resist removal of the cage wires from the inlets with considerably more force than needed to insert the cage wire into the inlets. In one aspect of the invention, the clips are formed of flat elongated resilient steel loops welded to the tie wires at inclined angles. The clips have inclined elongated internal openings with cam surfaces that draw the stirrup mat securely against a cage when the stirrup mat is slid in a predetermined direction, downwardly on a vertical cage, after the cage wires have been engaged in the clips. In another aspect of the invention resilient clips having one-way inlets are attached to outer ends of the stirrup elements for attachment to a second wire cage. The clips may have enlarged outer loops that serve as spacers.

15 Claims, 5 Drawing Sheets

SELF-LOCKING STIRRUP MAT

FIELD OF THE INVENTION

The present invention relates to a self-locking stirrup mat that attaches to a wire concrete reinforcement cage without the use of wire ties.

BACKGROUND OF THE INVENTION

Stirrup mats are used in connection with reinforced concrete products in order to provide added shear stress reinforcement for the concrete. A stirrup mat typically comprises a mat formed of a wire grid having a series of reinforcement prongs attached to the wire so as to extend at right angles to the plane of the mat. A stirrup mat is generally attached by wire ties to one of two concentric wire grid reinforcement cages used for the reinforced concrete. The mat may be attached to the inner or outer side of either wire cage, with the prongs extending between the cages. In either case, it is customary for the wire grid of the stirrup mat to be fastened to the reinforcement cage by flexible wire ties. This is a very time consuming process and involves a substantial amount of manual labor. It would be desirable to have a stirrup mat that simply clips into position in a wire cage, but this has been difficult to achieve because it is necessary that the stirrup mat be secured firmly in place and not be dislodged by fairly strong forces of the type that a stirrup mat is routinely subjected to. Moreover, the wire spacing of reinforcement cages is irregular, so it is not possible to employ clips that require a specific cage wire position or spacing.

An object of the present invention is to provide an easy to assemble self locking stirrup mat that is held securely in place by a snap-on, self-locking attachment mechanism and is compatible with cage wires of varying spacing.

SUMMARY OF THE INVENTION

In accordance with the present invention, a self-locking stirrup mat for providing supplemental reinforcement for a poured concrete structure comprises a stirrup mat formed of an interconnected grid of reinforcement wires with stirrup elements attached to the grid wires so as to protrude from the grid. The stirrup mat includes a self-locking clip attachment mechanism for attaching the stirrup mat to a wire cage without the necessity for tie wires. The attachment mechanism comprises a plurality of self-locking resilient clips attached to the mat, with each clip comprising an inlet that resiliently cams open to admit a cage wire into an open interior of the clip when the stirrup mat is positioned against the cage and moved in a predetermined direction on the cage. The inlets desirably are one-way inlets that resist withdrawal of a cage wire from the clip with a force considerably stronger than the force necessary to insert a cage wire into the clip.

Desirably, the clips have elongated internal openings with inclined cam surfaces that draw the stirrup mat more securely into engagement with the cage wires as the mat slides along the cage.

In one aspect of the invention, the clips are formed in the shape of an elongated loop having an large end and a small end, with the large end protruding outwardly from the stirrup mat at an inclined angle and with a small end being positioned closer to the plane of the mat. The clips are formed and oriented so that when the mat is pressed against the cage and pushed in one direction the clips resiliently engage cage wires and receive them into the open interiors of the clips. When the stirrup mat is then slid toward the smaller ends of the clips, the stirrup mat is drawn more securely into engagement with the wire cage.

In another embodiment of the present invention, spring clips are attached to the outer ends of stirrup elements so that the stirrup mat can be pressed against one of two concentric wire cages and attached to the other wire cage by clipping the stirrup elements on circumferential wires of the other wire cage with self-locking clips.

The present invention is desirably employed with a stirrup mat having manually deformable tie wires that permit the stirrup mat to be manually formed to the outer configuration of a wire cage.

The clips are attached transversely to lateral tie wires of the stirrup mat and oriented in the same direction so that the stirrup mat is clipped on circumferential cage wires of the wire cage by sliding the stirrup mat along the side of the wire cage. After latching the clips on the wire cage, the stirrup mat is drawn tightly into contact with the wire cage by sliding the stirrup mat downwardly on a vertically oriented wire cage by manual manipulation or under the influence of gravity.

The self-locking stirrup mat of the present invention saves a very substantial amount of time in attaching a stirrup mat to a wire cage by eliminating use of tie wires which have to be attached individually.

These and other features and advantages of the present invention will become apparent from the embodiments described in detail below and shown in the appended drawings.

DETAILED DESCRIPTION OF THE PREFERRED EMBODIMENTS

Figure 1:
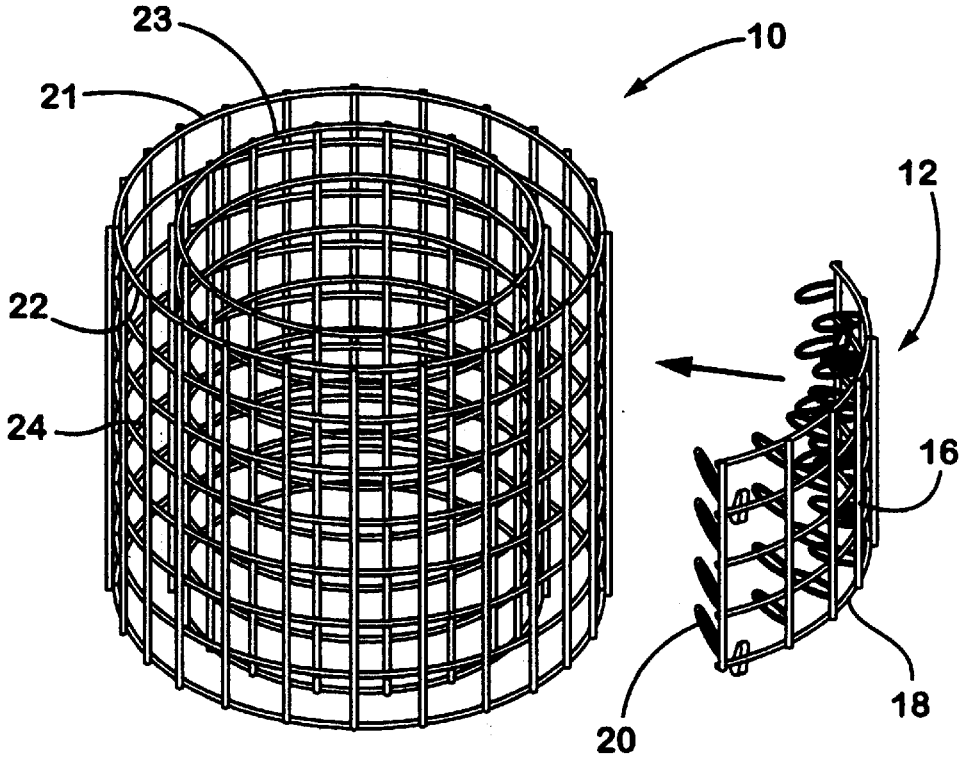
FIG. 1 is a perspective view of a double cage pipe reinforcement employing the stirrup mat of the present invention.
Figure 3:
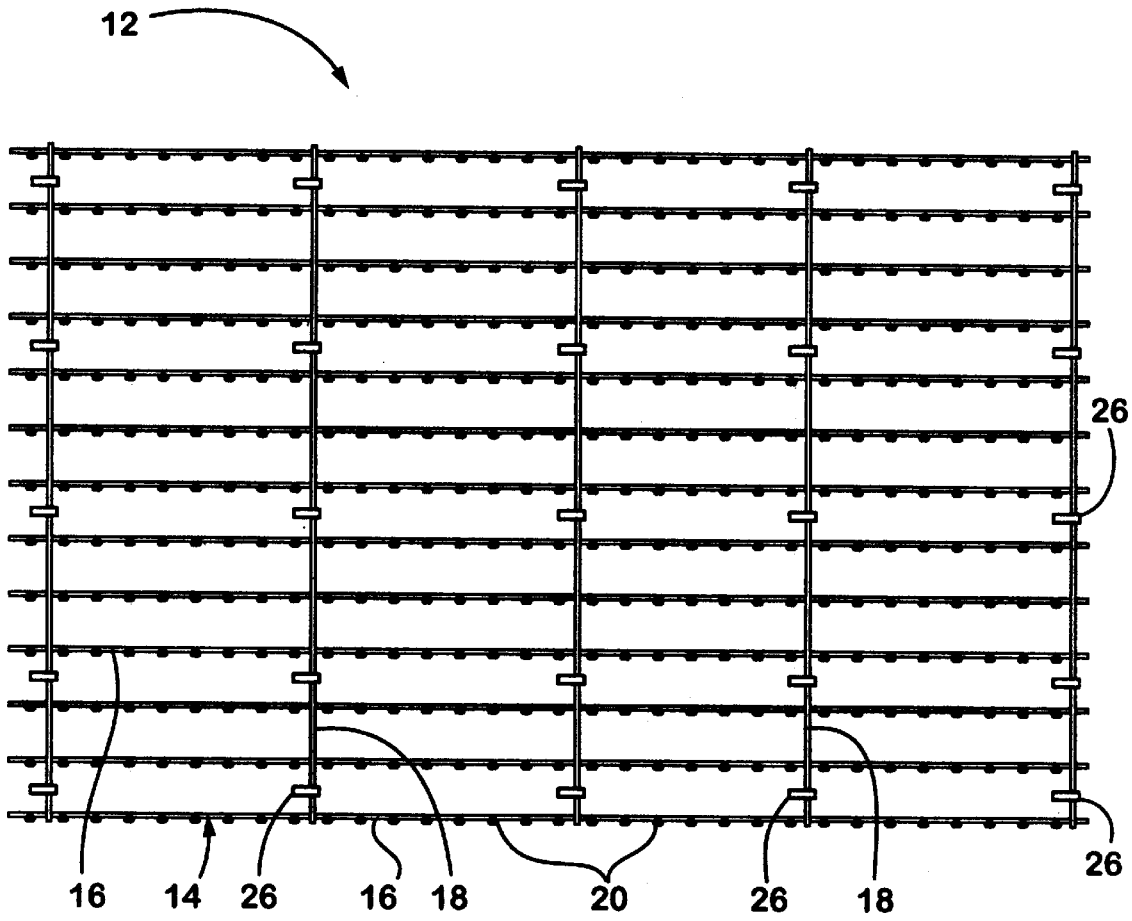
FIG. 3 is a plan view of the stirrup mat of FIG. 1.
Figure 4:
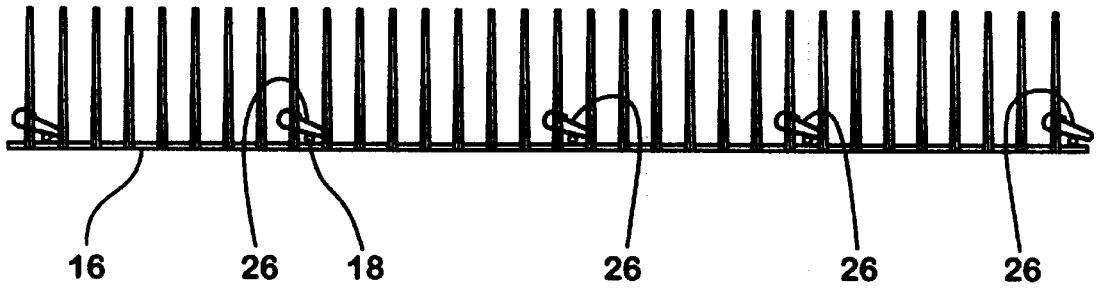
FIG. 4 is a side elevational view of the stirrup mat of FIG. 1.
Figure 5:
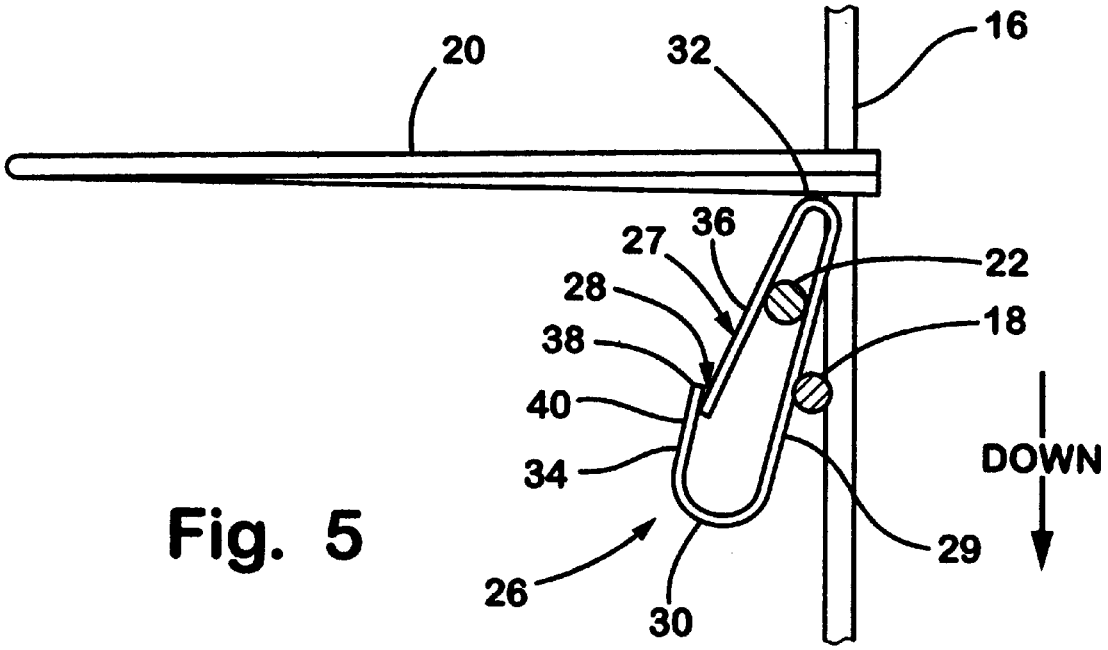
FIG. 5 is an enlarged partial side elevational view showing the clip of the stirrup mat of the present invention attached to a reinforcing cage.

Referring to the drawings, a wire reinforcement cage construction 10 for a concrete pipe, shown in FIG. 1, employs a self-locking stirrup mat 12. Stirrup mat 12 (FIG. 3) comprises a wire grid 14 formed of longitudinal wires 16 called element wires and transverse or circumferential wires 18 called tie wires. Desirably, the tie wires are manually formable for ease in installation, as shown in U.S. Pat. No. 4,184,520, which is incorporated herein by reference. Wire loops or prongs 20 called stirrup elements are fastened, usually by spot welding, to the element wires 16 of grid 14 so as to protrude at right angles from the grid.

Figure 2:
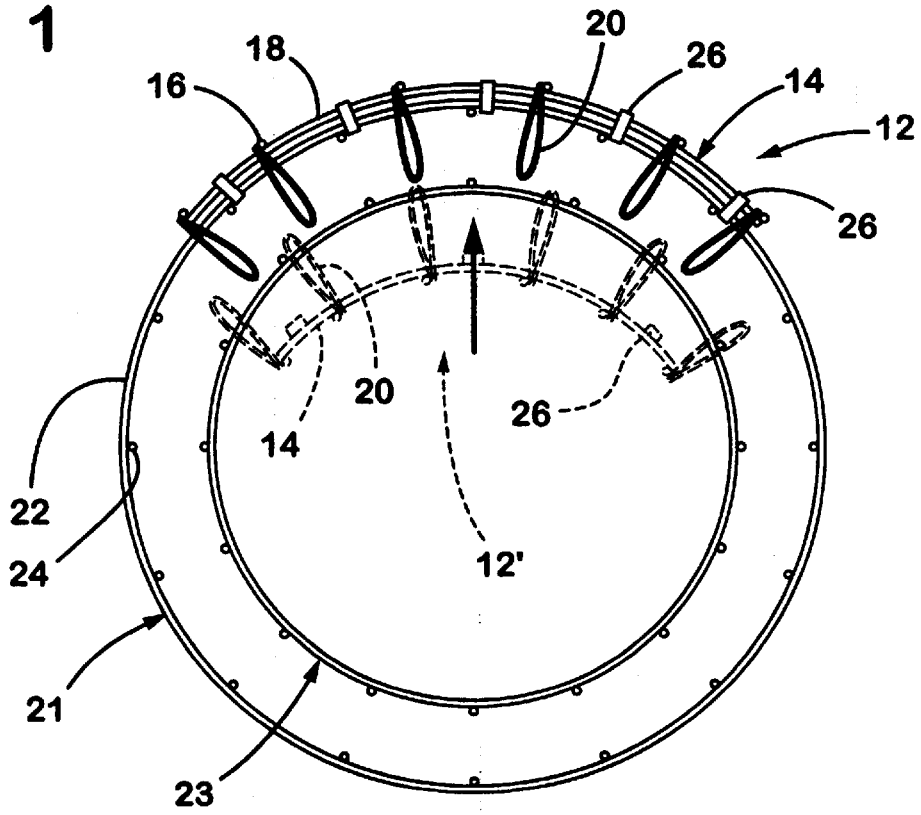
FIG. 2 is a schematic end view of a reinforcing cage for concrete pipe employing a self-locking stirrup mat in accordance with the present invention.

Stirrup mat 12 may be inserted in an outer wire reinforcement cage 21 in the manner shown in FIG. 1, wherein the mat is positioned on the outside of the cage and the stirrup elements extend through the wires of the cage, which comprise circumferential wires 22 and longitudinal wires 24. The circumferential wires can be circular or helical. Alternatively, the stirrup mat 12 may be inserted outwardly from the inner side of a cage 23, as shown in phantom in FIG. 2.

Stirrup mat 12 is held on the wire cage by an attachment mechanism comprising a plurality of spring clips 26 mounted on the wire grid which clip over the wires of the reinforcement cage.

The construction of one embodiment of clip 26 is shown in more detail in FIGS. 5–7D. Clip 26 is formed out of a strong, resilient material, preferably spring steel or other resilient tempered steel. The clip is formed in the shape of an egg shaped loop having a back 27 and a front 29, with a normally closed opening or inlet 28 positioned in the front between an end of the loop 30 on one side and another end of the loop 32 on the other side of the clip. Legs 34 and 36 have ends 38 and 40 which overlap at opening 28. The clip desirably is welded on the tie wire at an inclined angle. An angle of approximately 13.4° is preferred. In the pipe molding process a reinforcing cage is placed on end in a vertical position (axis vertical). The stirrup mat is then attached to a vertically oriented side of the cage. A pipe form is then placed over the cage. This orientation is shown in FIGS. 5 and 7A–D. The clips thus are inclined from a vertical axis in use, with the larger end 30 protruding outwardly from the plane of the mat further than the smaller end 32.

Figure 6:
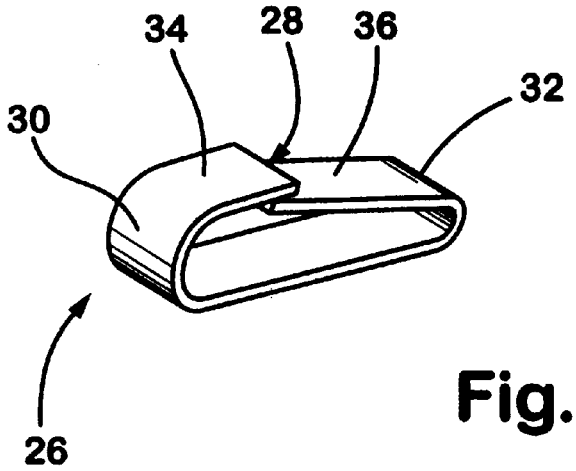
FIG. 6 is a perspective view of the clip of the present invention.
Figure 7A:
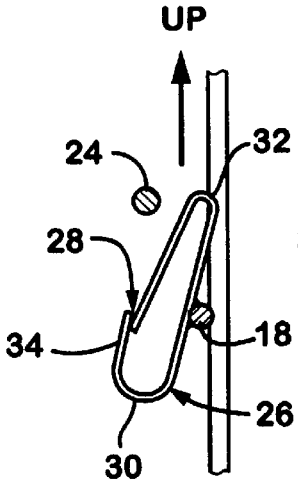
FIGS. 7A–7D are side elevational views showing the clip of the present invention being clipped over a reinforcement wire of a wire cage.
Figure 7B:
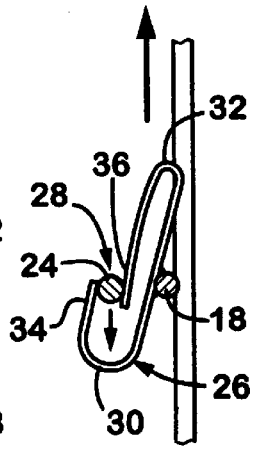
Figure 7C:
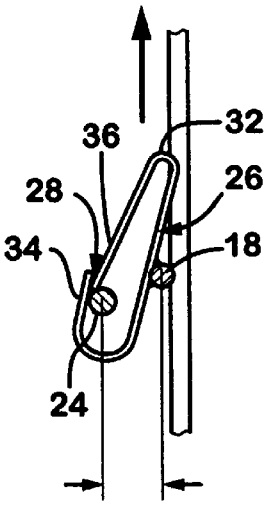
Figure 7D:
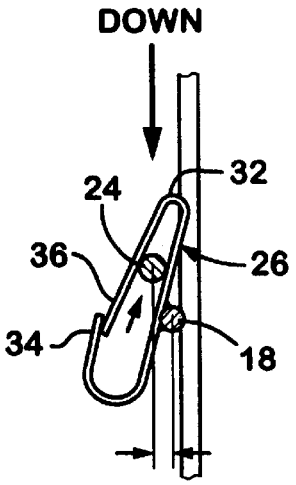

In order to mount a stirrup mat of the present invention on a reinforcing cage, the stirrup mat is first pressed against and deformed into the shape of the cage, and then the stirrup mat is lifted upwardly in a sliding movement (FIG. 7A). The clips protrude from the mat so that the circumferential cage wires engage legs 36 of the clips as the mat slides upwardly. This deflects leg 36 of each clip inwardly and enlarges opening 28 (FIG. 7B). As the stirrup mat is slid further on the cage, the cage wires are forced completely into the clips (FIG. 7C). As soon as each wire is fully inserted into the clip, leg 36 springs back into position against leg 34. The distance between the inner end of loop end 30 and the end 40 of leg 36 is greater than the diameter of circumferential cage wire 22, so that when the circumferential cage wire is fully inserted into the clip, the end of leg 36 can deflect outwardly to its normal position as shown in FIG. 6.

With the clip formed in this manner, the wires of the reinforcing cage can easily be inserted into the clips, but when inserted cannot be pulled out of the clips without great effort because of the overlapping ends of legs 34 and 36.

After the stirrup mat has been clipped on the cage the stirrup mat is slid downwardly on the cage. This action plus the downward movement caused by gravity slides the cage wires toward the small ends of the clip loops. Because the clips are inclined, this produces a cam action that draws the stirrup mat securely into engagement with the cage.

In the preferred practice of the present invention, the spring clips are formed of flat steel strips having a thickness of approximately 30–40 mils and having a width of approximately three-eighths (3/8) inches. This provides a strong and secure clip, while at the same time permitting sufficient resilient deflection of the legs of the clip to permit insertion of a cage wire into the clip. While a spring steel works well for the clips of the present invention, a lower carbon steel that is tempered or otherwise treated to the extent necessary to give it sufficient resilience that the clip will resiliently close after being opened for mounting the stirrup mat on a wire cage, will be satisfactory for purposes of the present invention. A lower carbon tempered steel could provide advantages in ease of welding and expense. Other resilient materials also may be used.

For most applications the clip desirably is about two inches long, has an inside diameter at the larger end of about 7/16 inches and an inside diameter at the smaller end of about 3/16 inches. This clip will accommodate cages employing a variety of wire sizes ranging from W3 to W10 (approximately 0.218 inches to 0.356 inches in diameter).

Figure 8:
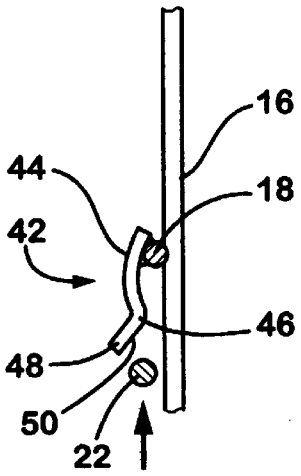
FIG. 8 is an side elevational view of an alternative embodiment of the clip of the present invention, shown in position to engage a circumferential cage wire.
Figure 9:
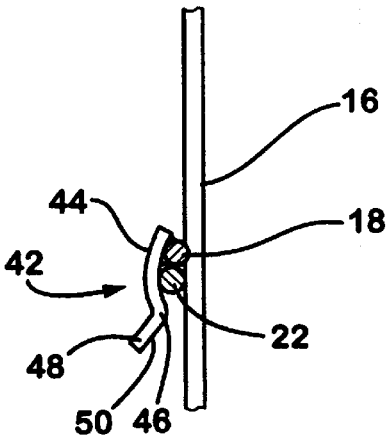
FIG. 9 is a side elevational view of the embodiment of FIG. 8 in engagement with a circumferential cage wire.

Another type of clip is shown in FIGS. 8 and 9. This clip 42 is attached to the same tie wire 18 as clip 26. Clip 42 is also formed of flat spring steel and is welded to wire 18. Clip 42 has a leg 44 that extends substantially parallel to wire 16 and has an outer end 46 that curves inwardly toward wire 16 to form a sharp corner. A beveled outer end 48 extends at an angle outwardly from end 46 so as to provide a cam surface 50 for engagement with circumferential cage wire 22. As shown in FIG. 8, when cage wire 22 is forced (upwardly) against cam surface 50, the spring clip is deflected outwardly until wire 22 is positioned inside of corner 46 and adjacent leg 44. The inwardly extending corner fits over the wire 22 and holds it resiliently in place in the clip.

Figure 10:
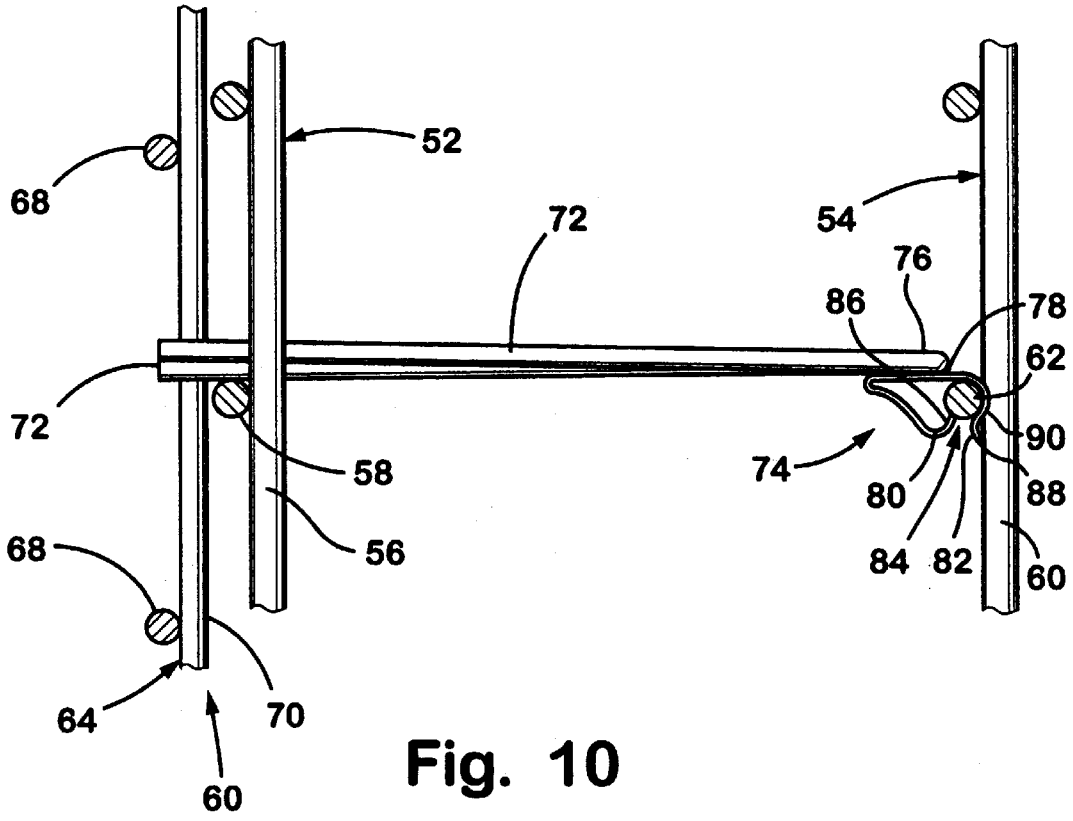
FIG. 10 discloses an alternative embodiment of the present invention for clipping a stirrup mat onto an opposite cage of a double cage reinforcement structure.
Figure 11:
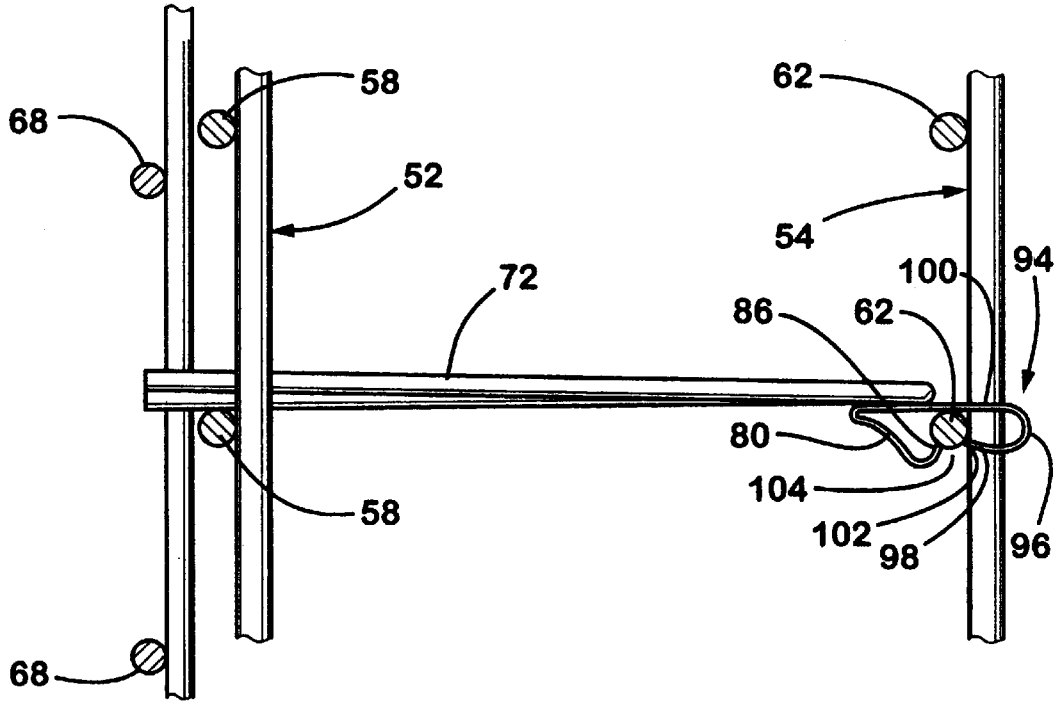
FIG. 11 is a side elevational view of another embodiment of the present invention designed for attachment to an opposite cage in a double cage wire reinforcement, wherein the spring clip also serves as an exterior spacer.

Two other embodiments of the present invention designed for attachment to the opposite cage of a double cage reinforcement are shown in FIGS. 10 and 11. Referring to FIG. 10, in this embodiment, two concentric cages 52 and 54 are employed, with cage 52 being an inside cage and cage 54 being an outside cage. Cage 52 comprises circumferential wires 58 and longitudinal wires 56, while cage 54 comprises circumferential wires 62 and longitudinal wires 60, each cage being formed in a grid construction. The circumferential wires may be circular or helical in any of the embodiments. Stirrup mat 64 also comprises a flat wire mat 66 formed of a grid of longitudinal element wires 70 and transverse tie wires 68, with loops or stirrup elements 72 extending perpendicularly to the plane of the mat and being attached by spot welding or the like to the element wires of the mat. A spring clip 74 is attached to an outer end 76 of certain stirrup elements. Spring clip 74 is formed of this same type of flat spring steel as the other stirrup mat clips described above. Clip 74 is formed in the shape of a partially closed loop having a back 78 attached to the stirrup and having a pair of legs 80 and 82 extending to an opening 84 between the ends of the legs. Leg 80 has an inwardly curved end 86, while leg 82 has an outwardly curved end 88, with the directions inward and outward referring to the interior or exterior of the loop. The opposed surfaces of ends 86 and 88 of the respective legs form cam surfaces that cause the loop to spread apart and permit the entry of wire 62 into the interior of the loop when the wire is pressed into the opening 84 in the loop. When wire 62 is inserted fully in the loop it nests on an arcuate surface 90 on one side of the loop, with end 86 of the clip bearing against the wire so as to hold it firmly against the arcuate surface in the clip. Thus, the spring clip can be fitted downwardly over the wire 62 easily and the legs of the clip will deflect apart by cam action to easily permit the wire to be inserted into the loop. However, when the reinforcing wire 62 is inserted fully into the loop, end 86 of leg 80 springs back into a locking position where no cam action is available, and the spring clip thus rather rigidly holds the reinforcing wire 62 in the interior of the clip.

Another version 94 of the spring clip is shown in FIG. 10. This version is similar to clip 74 of FIG. 8 but end 90 and leg 82 of clip 74 are replaced with an enlarged looped end 96 that extends outwardly past the exterior surface of the outside cage. Leg 98 of loop 96 curves inwardly toward the back 100 of the loop with end 102 of leg 98 terminating at a distance from end 86 of leg 80 that is less than the diameter of wire 62. The inclined surfaces leading to ends 102 and 86 constitute cam surfaces which are deflected inwardly and apart when wire 62 is pressed inwardly into opening 104 in the clip. When the wire is fully inserted into the clip, ends 86 and 102 deflect outwardly to the positions shown in FIG. 10, where they serve to prevent wire 62 from being retracted from the clip. With this clip, the clip can be easily inserted on the wire reinforcing cage but it is much more difficult to remove the clip from the cage once it is attached. End 96 extends outwardly beyond the outside cage and thus serves as a spacer to space the outer cage from the wall of a mold or form for the concrete pipe.

In all of the embodiments of the present invention, the spring clip comprises a resilient clip having an inlet opening that permits a wire to be inserted into the interior of the clip but resists removal of the wire from the clip.

The foregoing illustrates preferred embodiments of the present invention. It should be understood that various modifications in the arrangements and details of construction of the preferred embodiments are included within the spirit and scope of the present invention.

I claim:

1. In a stirrup mat for reinforcing a wire reinforcement cage for a poured concrete structure, wherein the stirrup mat comprises a grid of interconnected wires with stirrup elements projecting from the grid, the improvement comprising a plurality of self-locking clips attached to the mat, each clip comprising a loop of resilient material having a one-way inlet into the interior of the loop, such that a cage wire can fit through the inlet into the interior of the loop but cannot be removed from the clip through the inlet, at least without the application of considerably more force than required for insertion of the cage wire into the loop, the clips being attached to the mat in a position such that the inlets are positioned to engage and receive cage wires therein when the stirrup mat is moved in a predetermined direction while in engagement with the cage.

2. A stirrup mat according to claim 1 wherein the loop of the clip is elongated, and the inlet is formed between opposing legs of the clip, at least one leg being shaped and positioned so as to resiliently deflect away from the inlet to permit the insertion of a cage wire into the interior of the loop when the cage wire is pressed against the leg in the predetermined direction, the legs being formed and positioned such that a considerably greater force is required to remove the cage wire from the inlet than to insert the cage wire.

3. A self-locking stirrup mat according to claim 2 wherein ends of the legs of the clip overlap at the inlet, with one leg being positioned inside of another leg, the one leg being resiliently deflectable inwardly to permit insertion of a cage wire into the clip, engagement between the end of the one leg and the end of the other leg serving to resist withdrawal of the cage wire from the clip by outward deflection of the one leg.

4. A self-locking stirrup mat according to claim 1 wherein the clips are mounted transversely on manually formable stirrup mat tie wires.

5. A self-locking stirrup mat according to claim 1 wherein each clip has a front that faces the cage wire to which the stirrup mat is to be attached when the stirrup mat is oriented for attachment to the cage, the inlet in the loop being in the front of the clip, the clips oriented in the same direction and being fastened to the stirrup mat grid in inclined positions, such that when the stirrup mat is pressed against the cage and slid longitudinally along the cage in the predetermined direction, the clips engage cage wires and are caused to open and receive the cage wire therein through the inlets, subsequent movement of the clips in an opposite direction serving to engage interior cam surfaces in the clips with the cage wires so as to draw the stirrup mat into closer engagement with the wire cage.

6. A self-locking stirrup mat according to claim 1 wherein each of the clips comprises an elongated loop having a back attached to a tie wire of the stirrup mat and a front facing away from the mat, the inlet being formed in the front of the clip and being defined as the space between adjacent ends of legs of the loop that terminate at the inlet from opposite sides thereof, the loop having first and second ends at opposite ends of the loop, the loop being attached to the tie wire in a position such that the first end of the loop protrudes further outwardly from the grid than the second end of the loop and the loop having a cam surface extending along the front interior of the loop between the first and second ends, the inlet in the clip being positioned for receipt of a cage wire into the clip adjacent the first end, the cage wire engaging the cam surface as the stirrup mat is thereafter slid along the cage in a direction from the first end toward the second end, causing the cage wire to be drawn closer to the stirrup mat as the cage wire moves from the first toward the second end of the clip, thereby locking the stirrup mat securely on the wire cage.

7. A self-locking stirrup mat according to claim 6 wherein the inlet is positioned adjacent the first end of the clip, with the first end being larger in cross section than the second end, the clip legs on the front side comprising a shorter leg extending from the first end and a longer leg extending from the second end, with the end of the shorter leg overlapping and being positioned outside the end of the longer leg.

8. A self-locking stirrup mat according to claim 7 wherein the tie wires are manually formable such that the stirrup mat can be manually bent to conform with a circular configuration of a pipe reinforcement cage, with the clips being spaced along the tie wires so as to be brought into position to engage the circumferential cage wires when the stirrup mat is pressed against the wire cage with the tie wires generally parallel with the circumferential wires of the cage, the clips being oriented transversely on the stirrup mat tie wires, such that when the wire cage is oriented with its axis vertical, the stirrup mat can be locked on the circumferential wires of the cage by sliding the stirrup mat upwardly on the cage until the clips engage and receive therein the cage wires, the stirrup mat being drawn more securely against the cage as the stirrup mat is moved downwardly on the cage, either by manual manipulation of the stirrup mat or under the influence of gravity or both.

9. A self-locking stirrup mat for providing supplemental reinforcement for wire cage concrete reinforcement comprising:

a stirrup mat formed of an interconnected grid of longitudinal element wires and transverse tie wires, with protruding stirrup elements being attached to the element wires; and a self-locking clip attachment mechanism permanently attached to the stirrup mat for attaching the stirrup mat on a wire cage without the use of tie wires, the attachment mechanism comprising a plurality of resilient fasteners in the form of resilient clips fixed to the mat at spaced locations thereon and protruding from the grid so as to be engageable with parallel wires on a wire cage, the clips being oriented in the same direction and having inlets into open interiors thereof, the inlets being shaped to cam open and receive cage wires therein when the stirrup mat is placed against the cage and moved in a predetermined direction toward the cage wires.

10. A self-locking stirrup mat according to claim 9 wherein the clips are oriented such that when the stirrup mat is mounted on a vertically oriented cage having a column of horizontally disposed cage wires the stirrup mat can be attached to the cage by placing the stirrup mat against the cage and sliding the stirrup mat downwardly on the surface of the cage, such action causing the clips to engage the horizontal cage wires.

11. A self-locking stirrup mat according to claim 9 wherein the inlets are one-way inlets that resist removal of a cage wires from the inlets with substantially greater force than the force required to insert the cage wires into the clips through the inlets.

12. A self-locking stirrup mat according to claim 9 wherein at least the clips have elongated internal openings, with inclined cam surfaces leading from protruding ends of the clips to less protruding ends of the clips, such that movement of the stirrup mat in a first direction on a wire cage causes engagement of the clips on the cage wires at the more protruding ends, and subsequent movement of the stirrup mat on the wire cage in a direction toward the less protruding ends causes the cage wires to engage the cam surfaces and draw the stirrup mat more securely into engagement with the wire cage.

13. A self-locking stirrup mat for providing supplemental reinforcement for wire cage concrete reinforcement employing first and second spaced cages; the self-locking stirrup mat comprising:

a stirrup mat formed of an interconnected grid of longitudinal element wires and transverse tie wires, with protruding stirrup elements being attached to the element wires, the tie wires being manually formable to permit manual formation of the mat to conform with an arcuate outer configuration of a wire cage; and a self-locking clip attachment mechanism permanently attached to the stirrup mat for attaching the stirrup mat to the wire cages without the use of tie wires, the attachment mechanism comprising a plurality of resilient fasteners in the form of resilient clips fixed to outwardly protruding ends of some of the stirrup elements of the mat such that the grid can be positioned against one of the cages and the clips can be engaged with the other of the cages, the clips having one-way inlets that resist removal of cage wires from the inlets with a substantially greater force than the force necessary to insert the cage wires into the clips through the inlets, the clips being oriented such that the clips are engaged on the cage wires by moving the stirrup mat with respect to the wire cage in a predetermined direction.

14. A self-locking stirrup mat according to claim 12, wherein at least some of the clips have outwardly extending loop portions that protrude outwardly beyond the wire cage to which the clips are fastened to so as to serve as spacers to space the wire cage from an adjacent concrete form.

15. A self-locking stirrup mat for providing supplemental reinforcement for wire cage concrete reinforcement comprising:

a stirrup mat formed of an interconnected grid of longitudinal element wires and transverse tie wires, with protruding stirrup elements being attached to the element wires, the tie wires being manually formable to permit manual formation of the mat to conform with an arcuate outer configuration of a wire cage; and a self-locking clip attachment mechanism permanently attached to the stirrup mat for attaching the stirrup mat on a wire cage without the use of tie wires, the attachment mechanism comprising a plurality of resilient fasteners in the form of resilient clips fixed to the mat at spaced locations thereon and protruding from the grid so as to be engageable with parallel wires on a wire cage, the clips being oriented in the same direction and having inlets into open interiors thereof, the inlets being shaped to cam open and receive cage wires therein when the stirrup mat is placed against the cage and moved in a predetermined direction toward the cage wires, the inlets being one-way inlets that resist removal of the cage wires from the inlets with substantially greater force than the force required to insert the cage wires into the clips through the inlets, at least some of the clips having elongated internal openings with inclined cam surfaces leading from protruding ends of the clips to less protruding ends of the clips, such that movement of the stirrup mat in a first direction on a wire cage causes engagement of the clips on the cage wires at the more protruding ends, and subsequent movement of the stirrup mat on the wire cage in a direction toward the less protruding ends causes the cage wires to engage the cam surfaces and draw the stirrup mat more securely into engagement with the wire cage.

* * * * *